US009562329B2

(12) United States Patent
Nagoshi et al.

(10) Patent No.: US 9,562,329 B2
(45) Date of Patent: Feb. 7, 2017

(54) COATED PRINTING PAPER FOR INDUSTRIAL INKJET PRINTING PRESS

(71) Applicant: MITSUBISHI PAPER MILLS LIMITED, Tokyo (JP)

(72) Inventors: Masanori Nagoshi, Tokyo (JP); Jun Urasaki, Tokyo (JP)

(73) Assignee: MITSUBISHI PAPER MILLS LIMITED, Tokyo (JP)

( * ) Notice: Subject to any disclaimer, the term of this patent is extended or adjusted under 35 U.S.C. 154(b) by 0 days.

(21) Appl. No.: 15/111,245

(22) PCT Filed: Jan. 9, 2015

(86) PCT No.: PCT/JP2015/050485
§ 371 (c)(1),
(2) Date: Jul. 13, 2016

(87) PCT Pub. No.: WO2015/107991
PCT Pub. Date: Jul. 23, 2015

(65) Prior Publication Data

US 2016/0333527 A1 Nov. 17, 2016

(30) Foreign Application Priority Data

Jan. 14, 2014 (JP) ..... 2014-004127
Jan. 14, 2014 (JP) ..... 2014-004129

(51) Int. Cl.
*B41M 5/00* (2006.01)
*D21H 21/52* (2006.01)
(Continued)

(52) U.S. Cl.
CPC ..... *D21H 21/52* (2013.01); *B41M 5/502* (2013.01); *B41M 5/508* (2013.01); *B41M 5/5218* (2013.01);
(Continued)

(58) Field of Classification Search
CPC ..... B41M 5/502; B41M 5/508; B41M 5/5218; B41M 5/5245
See application file for complete search history.

(56) References Cited

U.S. PATENT DOCUMENTS

2013/0176371 A1 7/2013 Nagoshi et al.
2013/0187977 A1* 7/2013 Idei ..... D21H 19/44 347/20
(Continued)

FOREIGN PATENT DOCUMENTS

JP 2002-234247 A 8/2002
JP 2005-88525 A 4/2005
(Continued)

OTHER PUBLICATIONS

Miyagi, "Offset Quality Inkjet Printer", Japan Printer, Insatsu Gakkai Shuppanbu Ltd., Aug. 2010, vol. 93, pp. 25-29.
(Continued)

*Primary Examiner* — Betelhem Shewareged
(74) *Attorney, Agent, or Firm* — Birch, Stewart, Kolasch & Birch, LLP

(57) ABSTRACT

A task of the present invention is to provide a coated printing paper for an industrial inkjet printing press, which has printability for a conventional printing press for use in, e.g., offset printing, and which has printability that can cope with the printing speed of an industrial inkjet printing press. An embodiment of the present invention is a coated printing paper for an industrial inkjet printing press, having a support; and, on at least one surface of the support, a coating layer containing at least a binder, a cationic compound, and ground calcium carbonate which, in a particle size distribution curve thereof, has at least one peak and has a half band
(Continued)

width of 0.25 μm or less with respect to the maximum peak, and which has an average particle diameter of 0.10 to 0.28 μm.

10 Claims, 1 Drawing Sheet

(51) Int. Cl.

| | |
|---|---|
| ***D21H 19/38*** | (2006.01) |
| ***D21H 19/56*** | (2006.01) |
| ***B41M 5/52*** | (2006.01) |
| ***B41M 5/50*** | (2006.01) |

(52) U.S. Cl.
CPC ..... *B41M 5/5245* (2013.01); *D21H 19/385* (2013.01); *D21H 19/56* (2013.01)

(56) References Cited

U.S. PATENT DOCUMENTS

| | | | |
|---|---|---|---|
| 2014/0363581 | A1 | 12/2014 | Nagoshi et al. |
| 2015/0273819 | A1 | 10/2015 | Nagoshi et al. |
| 2015/0283840 | A1 | 10/2015 | Nagoshi et al. |

FOREIGN PATENT DOCUMENTS

| | | | | |
|---|---|---|---|---|
| JP | 2006-224323 | A | 8/2006 | |
| JP | 2008-200963 | A | 9/2008 | |
| JP | 2010-100039 | A | 5/2010 | |
| JP | 2011-132646 | A | 7/2011 | |
| JP | 2011-132647 | A | 7/2011 | |
| JP | 2011-132648 | A | 7/2011 | |
| JP | 2011-132649 | A | 7/2011 | |
| JP | 2011-251231 | A | 12/2011 | |
| JP | 2014-76636 | A | 5/2014 | |
| WO | WO 2012/043322 | A1 | 4/2012 | |
| WO | WO 2012/043323 | A1 * | 4/2012 | ..... D21H 19/44 |
| WO | WO 2013/108753 | A1 | 7/2013 | |
| WO | WO 2014/057944 | A1 | 4/2014 | |
| WO | WO 2014/069189-A1 | A1 | 5/2014 | |

OTHER PUBLICATIONS

Tokumasu, "Inkjet Printer Compatible with B2 Wide Format Printing Paper", Japan Printer, Insatsu Gakkai Shuppanbu Ltd., Aug. 2010, vol. 93, pp. 21-24.

* cited by examiner

COATED PRINTING PAPER FOR INDUSTRIAL INKJET PRINTING PRESS

FIELD OF THE INVENTION

The present invention relates to a coated printing paper for an industrial inkjet printing press.

BACKGROUND ART

Ink-jet recording method techniques have rapidly advanced, and industrial inkjet printing presses which employ an ink-jet recording method in an industrial or commercial printing press for producing a number of printed materials are disclosed in various documents (see, for example, patent documents 1 and 2 and non-patent documents 1 and 2). These industrial inkjet printing presses are marketed under the trade names, for example, TruepressJet of Dainippon Screen Mfg. Co., Ltd., Prosper and VERSAMARK of Eastman Kodak Company and JetPress of FUJIFILM Corporation.

The industrial inkjet printing press exhibits a color printing speed which is ten to several tens times faster than an ink-jet printer for so-called SOHO or a large format printer, and which, though, varies depending on various printing conditions, and the printing speed of the industrial inkjet printing press is 15 in/min or more, and the printing speed of that of a higher speed type is more than 60 m/min.

The industrial inkjet printing press can deal with variable information and therefore can be applied to on-demand printing. Printing companies frequently employ a form of printing method in which printing for fixed information is made by a conventional printing press, such as a gravure printing press or an offset printing press, and printing for variable information is made by an industrial inkjet printing press. That is, both printing by a conventional printing press, such as an offset printing press, and printing by an industrial inkjet printing press are performed with respect to a single sheet of printing paper.

However, conventional coated printing paper, such as coated paper for offset printing, is unsatisfactory in the applicability to an industrial inkjet printing press, and cannot achieve satisfactory image quality as a commercial product due to a lack of the ink fixing property or a lack of the ink absorbing capacity. Conventional exclusive paper to an ink-jet printer is unsatisfactory in the applicability to a conventional printing press, such as an offset printing press, and causes printing failure, such as blanket piling, due to a lack of the coating layer strength, making it difficult to obtain satisfactory image quality as a commercial product. Further, the conventional exclusive paper to an inkjet printer is not intended to be used at a printing speed as high as that of an industrial inkjet printing press, and therefore is likely to lack the ink absorption speed or lack the appropriate diffusion of ink droplets when used in an industrial inkjet printing press. The individual factors are likely to cause the image to be stained or cause a white defect in the solid printed region, making it impossible to obtain a printed material having satisfactory image quality as a commercial product.

An ink-jet recording paper used according to a system in which an ink fixing agent is supplied to the recording paper before printing has been known, wherein the ink-jet recording paper has formed, on at least one surface of a support in a sheet form, a coating layer mainly made of an inorganic pigment and a binder, wherein the inorganic component/organic component ratio in any portion of the coating layer near the surface as determined by thermogravimetry is in the range of from 97/3 to 70/30, wherein when the total of the inorganic components in the whole of the coating layer is taken as 100 parts by mass, any of ground calcium carbonate, precipitated calcium carbonate, and kaolin or a mixture of two or more of these pigments is contained as the inorganic component in an amount of more than 95 parts by mass, wherein the average particle diameter of the whole of the pigments is 0.02 to 2.00 μm (see, for example, patent document 3).

Further, a pigment coated glossy paper for printing suitable for hybrid printing, which has excellent offset printability, and which has printability for a high-speed inkjet printer using an aqueous pigment based ink, has been known, wherein the pigment coated glossy paper for printing has an inner pigment coating layer and a surface pigment coating layer, wherein the surface pigment coating layer contains, as a pigment, precipitated calcium carbonate having an average short diameter of 0.8 μm or less, and, as a binder, a styrene-butadiene copolymer latex, or a styrene-butadiene copolymer latex and casein, or a styrene-butadiene copolymer latex and a styrene-acryl copolymer latex, wherein an aqueous solution of a water-soluble multivalent metal salt is applied to the surface pigment coating layer and dried (see, for example, patent documents 4 to 7).

PRIOR ART REFERENCES

Patent Documents

Patent document 1: Japanese Unexamined Patent Publication No. 2011-251231

Patent document 2: Japanese Unexamined Patent Publication No. 2005-088525

Patent document 3: Japanese Unexamined Patent Publication No. 2010-100039

Patent document 4: Japanese Unexamined Patent Publication No. 2011-132646

Patent document 5: Japanese Unexamined Patent Publication No. 2011-132647

Patent document 6: Japanese Unexamined Patent Publication No. 2011-132648

Patent document 7: Japanese Unexamined Patent Publication No. 2011-132649

Non-Patent Documents

Non-patent document 1: "Ink-jet printer applicable to B2-size printing paper", written by Michiko Tokumasu ("Japan Printer", published by Insatsu Gakkai Shuppanbu Ltd., August 2010 (Vol. 93), pages 21 to 24)

Non-patent document 2: "Offset-quality ink jet printer", written by Yasutoshi Miyagi ("Japan Printer", published by Insatsu Gakkai Shuppanbu Ltd., August 2010 (Vol. 93), pages 25 to 29)

SUMMARY OF THE INVENTION

Problems to be Solved by the Invention

The inkjet recording paper described in patent document 3 does not always exhibit satisfactory printability for both an industrial inkjet printing press which is not according to a system in which an ink fixing agent is supplied to the recording paper before printing, and which has a high printing speed, and a conventional printing press, such as an offset printing press.

The pigment coated glossy paper for printing described in patent documents 4 to 7 has printability for an offset printing press; however, satisfactory studies on practical printing of the pigment coated paper by an industrial inkjet printing press has not been made, and therefore a further improvement of the printability for an industrial inkjet printing press is desired.

Further, the printed material by an industrial inkjet printing press has no problem about the image quality, but is likely to have a poor rub resistance such that the ink is peeled off when the printed material is rubbed with a hand. A printed material having a poor rub resistance cannot be used as a commercial product. The rub resistance affects the handling properties of a printed material after printing, and therefore becomes more important as the printing speed is increasing.

For the reasons of the above-mentioned problems, coated printing paper for an industrial inkjet printing press has not yet been achieved at present. Particularly, coated printing paper having printability for both an industrial inkjet printing press and a conventional printing press, such as an offset printing press, is desired. Further, there is desired coated printing paper for an industrial inkjet printing press, which can produce, using an industrial inkjet printing press, printed materials having satisfactory image quality as a commercial product, such as booklets, catalogues, and pamphlets, that require excellent image quality, as compared to leaflets that do not need excellent image quality.

An object of the present invention is to provide a coated printing paper for an industrial inkjet printing press, which has printability for a conventional printing press for use in, for example, offset printing, and which has printability that can cope with the printing speed of an industrial inkjet printing press.

Means for Solving the Problems

The object of the present invention is achieved by the coated printing paper for an industrial inkjet printing press of the present invention having the construction shown below.

<1> A coated printing paper for an industrial inkjet printing press, having: a support; and, on at least one surface of the support, a coating layer containing at least a binder, a cationic compound, and ground calcium carbonate which, in a particle size distribution curve thereof, has at least one peak and has a half band width of 0.25 μm or less with respect to the maximum peak, and which has an average particle diameter of 0.10 to 0.28 μm.

<2> The coated printing paper for an industrial inkjet printing press according to item <1> above, wherein the coating layer comprises a single layer.

<3> The coated printing paper for an industrial inkjet printing press according to item <1> or <2> above, wherein the amount of the ground calcium carbonate contained in the coating layer is 60 parts by mass or more, relative to 100 parts by mass of the total of a pigment in the coating layer.

<4> A coated printing paper for an industrial inkjet printing press, having a support, and, on at least one surface of the support, two or more coating layers each comprised mainly of a pigment and a binder, wherein the at least one pigment in the outermost layer formed furthest from the support as a basis is ground calcium carbonate which, in a particle size distribution curve thereof, has at least one peak and has a half band width of 0.25 μm or less with respect to the maximum peak, and which has an average particle diameter of 0.10 to 0.28 μm, wherein the amount of the ground calcium carbonate contained in the outermost layer is 60 parts by mass or more, relative to 100 parts by mass of the total of the pigment in the outermost layer, wherein the outermost layer contains a cationic compound.

<5> The coated printing paper for an industrial inkjet printing press according to any one of items <1> to <3> above, wherein the coating layer contains a cationic resin and a water-soluble multivalent cation salt as the cationic compound, wherein the cationic resin is a polycondensation product of an alkylamine and an epihalohydrin compound or a diallylamine-acrylamide copolymer, and wherein the water-soluble multivalent cation salt is a calcium salt.

<6> The coated printing paper for an industrial inkjet printing press according to item <4> above, wherein the outermost layer contains a cationic resin and a water-soluble multivalent cation salt as the cationic compound, wherein the cationic resin is a polycondensation product of an alkylamine and an epihalohydrin compound or a diallylamine-acrylamide copolymer, and wherein the water-soluble multivalent cation salt is a calcium salt.

<7> The coated printing paper for an industrial inkjet printing press according to any one of items <1> to <3> and <5> above, which has a support containing no boric acid compound and no borate compound, and, on at least one surface of the support, a coating layer containing at least a binder, a cationic compound, and ground calcium carbonate which, in a particle size distribution curve thereof, has at least one peak and has a half band width of 0.25 μm or less with respect to the maximum peak, and which has an average particle diameter of 0.10 to 0.28 μm.

<8> The coated printing paper for an industrial inkjet printing press according to item <4> or <6> above, which has a support containing no boric acid compound and no borate compound, and, on at least one surface of the support, two or more coating layers each comprised mainly of a pigment and a binder, wherein the at least one pigment in the outermost layer formed furthest from the support as a basis is ground calcium carbonate which, in a particle size distribution curve thereof, has at least one peak and has a half band width of 0.25 μm or less with respect to the maximum peak, and which has an average particle diameter of 0.10 to 0.28 μm, wherein the amount of the ground calcium carbonate contained in the outermost layer is 60 parts by mass or more, relative to 100 parts by mass of the total of a pigment in the outermost layer, wherein the outermost layer contains a cationic compound.

Effects of the Invention

By the present invention, there can be provided a coated printing paper for an industrial inkjet printing press, which has printability for a conventional printing press for use in, for example, offset printing, and which has printability that can cope with the printing speed of an industrial inkjet printing press. This is a coated printing paper for an industrial inkjet printing press, which can produce a printed material having satisfactory image quality as a commercial product.

MODE FOR CARRYING OUT THE INVENTION

Figure 1:
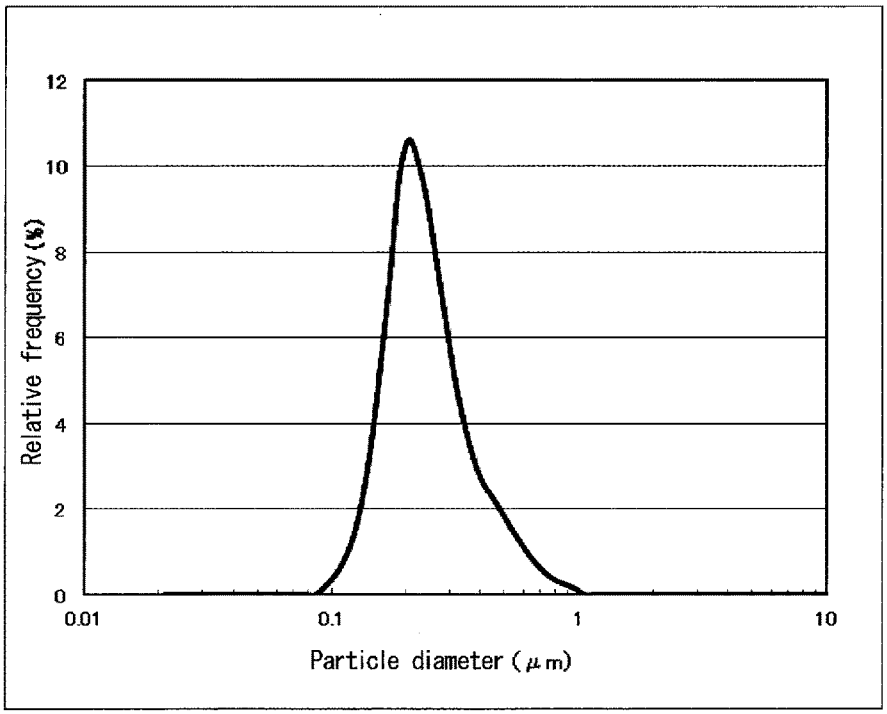
FIG. 1 shows a particle size distribution diagram of the ground calcium carbonate used in Example 1.

Hereinbelow, the present invention will be descried in detail.

In the present specification, the expression "satisfactory image quality as a commercial product" means that, after printing, in the resultant printed material, the coating layer is not peeled off, an imperfect image is not caused, the image of the printed material is not stained due to poor ink fixing, and the image of the printed material is not occurred stain or bleeding due to a lack of the ink absorption speed or ink absorbing capacity. Further, the expression "satisfactory image quality as a commercial product" also means that, with respect to an industrial inkjet printing press, the resultant printed material suffers no white defect in the printed portion due to poor dot diffusion of the ink droplets applied to a material to be printed and the printed material has excellent rub resistance such that the ink is hardly peeled off even when the printed material is rubbed with a hand, and, with respect to an offset printing press, printing failure, such as blanket piling, is not caused.

With respect to the industrial inkjet printing press, there are those of a roll sheet type and those of a cut sheet type according to the type of paper feeding method. The types of inks to be mounted on the industrial inkjet printing press include an aqueous dye based ink having a dye as a coloring material and an aqueous pigment based ink having a pigment as a coloring material. In the present invention, with respect to the type of each of the paper feeding method and the ink in the industrial inkjet printing press, any of the above types may be employed.

When variable information and fixed information are present in the image to be printed, it is preferred that part of or all of the fixed information is printed using a conventional printing press, such as a gravure printing press, an offset printing press, a letterpress printing press, a flexographic press, a thermal transfer printing press, or a toner printing press. Particularly, in view of the production cost and printing quality, an offset printing press is preferred. The printing using a conventional printing press may be performed either before or after printing using an industrial inkjet printing press.

The above-mentioned gravure printing press is a printer of an intaglio printing system in which an ink is transferred to a material to be printed through a roll-form plate cylinder having an image engraved therein. The above-mentioned offset printing press is a printer of an indirect printing system in which an ink is once transferred to a blanket and further transferred to a material to be printed. The above-mentioned letterpress printer is a printer of a relief printing system in which a pressure is applied so as to press an ink applied onto a relief printing plate against a material to be printed to perform printing. The above-mentioned flexographic press is a printer of a letterpress printing system using a flexible elastic resin plate. The above-mentioned thermal transfer printer is a printer using ink ribbons of respective colors, which is of a system in which coloring materials are transferred using heat from the respective ink ribbons to a material to be printed. The above-mentioned toner printer is a printer of an electrophotographic system in which a toner deposited on a charged drum is transferred to a material to be printed using static electricity.

In the present invention, the printing speed of the industrial inkjet printing press is 60 m/min or more. Even when the printing speed is less than the above value, industrial inkjet printing can be made. However, the remarkable effects of the present invention are recognized when the printing speed is 60 m/min or more. Further, from an industrial point of view, the productivity of printed materials is regarded as being important, and, for meeting demands for the productivity, it is desired that the printing speed is 60 m/min or more. When the coated printing paper is of a cut sheet type, the printing speed is calculated from the paper size printed per minute.

The construction of the present invention is described below. The coated printing paper for an industrial inkjet printing press of the present invention is roughly classified into the below-described coated printing paper for an industrial inkjet printing press according to the first embodiment of the invention and coated printing paper for an industrial inkjet printing press according to the second embodiment of the invention.

First Embodiment of the Invention

A coated printing paper for an industrial inkjet printing press, having a support, and, on at least one surface of the support, a coating layer containing at least a binder, a cationic compound, and ground calcium carbonate which, in a particle size distribution curve thereof, has at least one peak and has a half band width of 0.25 μm or less with respect to the maximum peak, and which has an average particle diameter of 0.10 to 0.28 μm.

Second Embodiment of the Invention

A coated printing paper for an industrial inkjet printing press, having a support, and, on at least one surface of the support, two or more coating layers each comprised mainly of a pigment and a binder, wherein the at least one pigment in the outermost layer formed furthest from the support as a basis is ground calcium carbonate which, in a particle size distribution curve thereof, has at least one peak and has a half band width of 0.25 μm or less with respect to the maximum peak, and which has an average particle diameter of 0.10 to 0.28 μm, wherein the amount of the ground calcium carbonate contained in the outermost layer is 60 parts by mass or more, relative to 100 parts by mass of the total of the pigment in the outermost layer, wherein the outermost layer contains a cationic compound.

In the first embodiment of the invention, when the coating layer comprises a single layer, an advantage is obtained from the viewpoint of the production cost. In the second embodiment of the invention, the coating layer being comprised mainly of a pigment and a binder means a state such that, in each coating layer, the proportion of the pigment and binder to each coating layer in terms of a dry solids content is the highest.

In the first and second embodiments of the invention, for improving the adhesion between the support and the coating layer, an undercoat layer may be formed between the coating layer and the support in such a range that the effects of the present invention are not sacrificed. Further, for improving the scuff resistance, a protective layer may be formed on the coating layer (the outermost layer when the two or more coating layers are present).

Particularly, in the second embodiment of the invention, when the two or more coating layers are present, the ink absorption speed or ink absorbing capacity can be advantageously improved by the under layer in contact with the support, and the gloss or surface texture can be advantageously improved by the outermost layer formed furthest from the support as a basis. Such a construction is preferred especially in a glossy coated printing paper for an industrial inkjet printing press. With respect to the number of the coating layers, there is no particular limitation as long as the number of the coating layers is two or more, but, from the viewpoint of the production cost and production stability, the two coating layers are preferred. In the second embodiment of the invention, the coating layer in contact with the support is referred to as "the under layer", and the coating layer formed furthest from the support as a basis is referred to as "the outermost layer". This applies to the first embodiment of the invention which has two or more coating layers.

When the coated printing paper for an industrial inkjet printing press of the present invention has three or more coating layers, the coating layer present between the under layer and the outermost layer is, for example, a coating layer comprised mainly of a pigment and a binder or a coating layer comprised mainly of a resin component, and the construction of the above coating layer is not particularly limited.

In the coated printing paper for an industrial inkjet printing press according to the first embodiment of the invention, as mentioned above, the coating layer contains ground calcium carbonate which, in a particle size distribution curve thereof, has at least one peak and has a half band width of 0.25 μm or less with respect to the maximum peak, and which has an average particle diameter of 0.10 to 0.28 μm. When the coating layer comprises two or more layers, for exhibiting the effects of the present invention, it is important that the outermost layer of the coating layers contains the above-mentioned ground calcium carbonate (as well as a binder and a cationic compound). The coating layer positioned on the under side may not contain the ground calcium carbonate or cationic compound.

In the coated printing paper for an industrial inkjet printing press according to the second embodiment of the invention, the outermost layer contains a predetermined amount of the same ground calcium carbonate as mentioned above.

In the present invention, when the average particle diameter of the ground calcium carbonate falls outside of the above-mentioned range, printability for an industrial inkjet printing press cannot be obtained, making it impossible to achieve satisfactory image quality as a commercial product in the printed material. Further, even in the case where the average particle diameter of the ground calcium carbonate is 0.10 to 0.28 μm, when the half band width of the maximum peak in the particle size distribution curve of the ground calcium carbonate does not satisfy the above-mentioned conditions, excellent printability for an industrial inkjet printing press cannot be obtained particularly in a high-speed region such that the printing speed is 150 m/min or more, making it impossible to achieve satisfactory image quality as a commercial product in the printed material. The printing speed is a matter relevant to the unit cost for printing and is important to printing companies.

In the present invention, with respect to the average particle diameter, in the case of individual particles, an average particle diameter of the individual particles is used, and, in the case where aggregate particles, such as secondary particles, are formed, an average particle diameter of the aggregate particles is used. An average particle diameter and a half band width of the maximum peak in a particle size distribution curve of the ground calcium carbonate can be determined from the ground calcium carbonate in the state of coated paper. As a method for the determination, for example, there can be mentioned a method in which, using a scanning electron microscope having an elemental analysis function, such as an energy dispersive X-ray spectrometer, an electron microscope photomicrograph is taken with respect to the surface of a coated printing paper, and a particle seen in the taken image is regarded as a circle which has an area approximating to that of the particle and a particle diameter of the circle is calculated, and particle diameters of 100 particles present in the image are measured to determine an average particle diameter by calculation. A particle size distribution curve in which the ordinate gives a relative frequency (%) and the abscissa gives a particle diameter (μm) can be obtained using a particle image analysis software from the particle diameter data measured with respect to the 100 particles. From the obtained particle size distribution curve, a width at a height which is ½ of the peak height of the maximum peak can be determined as a half band width. When the coated printing paper for an industrial inkjet printing press of the present invention has two or more coating layers, an average particle diameter of the coating layer(s) other than the outermost layer can be measured by removing the layer(s) present on the coating layer, the average particle diameter of which is to be determined.

The average particle diameter and the half band width of the maximum peak can also be determined by measurement using a laser diffraction-scattering method or a dynamic light scattering method. In such a case, the particle size distribution is a volume-based particle size distribution as measured by a laser diffraction-scattering type particle size analyzer. The average particle diameter is an average particle diameter based on the measurement of a volume-based particle size distribution using a laser diffraction-scattering method or a dynamic light scattering method. With respect to the average particle diameter, in the case of individual particles, an average particle diameter of the individual particles is used, and, in the case where aggregate particles, such as secondary particles, are formed, an average particle diameter of the aggregate particles is used. An average particle diameter and a half band width of the maximum peak in a particle size distribution curve can be calculated from the obtained particle size distribution. For example, a particle size distribution, an average particle diameter, and a half band width of the maximum peak in a particle size distribution curve can be calculated by measuring a particle size distribution using a laser diffraction-scattering type particle size distribution measurement apparatus Microtrac MT3300EXII, manufactured by Nikkiso Co., Ltd.

The term "maximum peak" means a peak having the highest top of the relative frequency among the one or more peaks in a particle size distribution curve. The particle size distribution curve in which the half band width of the maximum peak is small has the sharp maximum peak.

Figure 2:
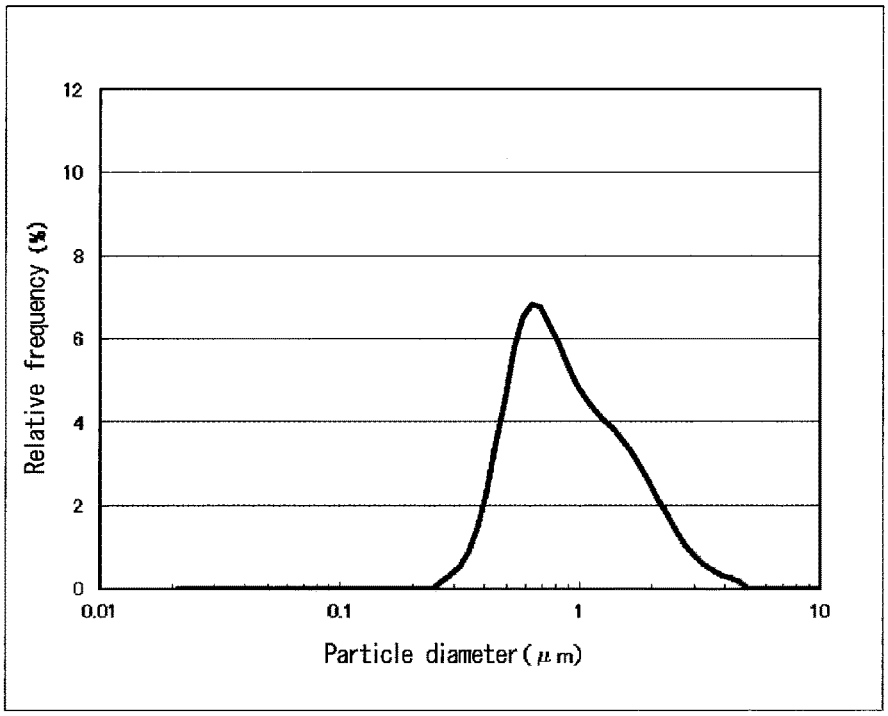
FIG. 2 shows a particle size distribution diagram of the commercially available ground calcium carbonate used in Comparative Example 7.

FIG. 1 shows an example of a particle size distribution curve of ground calcium carbonate having an average particle diameter of 0.10 to 0.28 μm, and having at least one peak and a half band width of 0.25 μm or less with respect to the maximum peak. FIG. 2 shows an example of a particle size distribution curve of ground calcium carbonate conventionally known in the field of coated paper (wherein the half band width of the maximum peak is more than 0.25 μm).

The ground calcium carbonate is produced by grinding natural limestone. Therefore, there is the produced ground calcium carbonate which has an average particle diameter similar to that of another one but has a particle size distribution different from that of the another one. Generally, ground calcium carbonate exhibits a particle size distribution curve having no sharp peak or having a widened peak (see FIG. 2). The ground calcium carbonate used in the present invention is fine particles having an average particle diameter of 0.10 to 0.28 μM and further has the sharp maximum peak, and this feature differentiates the ground calcium carbonate used in the present invention from conventionally known ground calcium carbonate.

It is preferred that the ground calcium carbonate does not contain particles having a particle diameter of more than 1.5 μm. The reason for this is that the image of the printed material in industrial inkjet printing can be further prevented from being stained.

In the first embodiment of the invention, the amount of the ground calcium carbonate contained in the coating layer is preferably 60 parts by mass or more, relative to 100 parts by mass of the total of pigments in the coating layer. The reason for this is that when the amount of the ground calcium carbonate in the coating layer is 60 parts by mass or more, relative to 100 parts by mass of the total of pigments in the coating layer, the resultant coated printing paper for an industrial inkjet printing press can achieve more excellent printability for an industrial inkjet printing press.

In the second embodiment of the invention, the amount of the ground calcium carbonate contained in the outermost layer is 60 parts by mass or more, relative to 100 parts by mass of the total of pigments in the outermost layer. When the amount of the ground calcium carbonate contained in the outermost layer is less than 60 parts by mass, relative to 100 parts by mass of the total of pigments in the outermost layer, the resultant coated printing paper for an industrial inkjet printing press cannot achieve excellent printability for an industrial inkjet printing press.

The ground calcium carbonate used in the present invention having a predetermined average particle diameter and half band width of the maximum peak can be produced by, for example, the method described below. Natural limestone is first dry ground, and the resultant powder is dispersed in water or an aqueous solution having a dispersant to prepare a pre-dispersed slurry of ground calcium carbonate. The thus prepared pre-dispersed slurry is further wet ground using, for example, a bead mill. Natural limestone can be directly wet ground. However, from the viewpoint of the productivity, it is preferred that natural limestone is first dry ground before being wet ground. In the dry grinding, limestone is desirably ground so that the resultant limestone has a particle diameter of 40 mm or less, preferably an average particle diameter of about 2 μm to 2 mm. In the wet grinding, it is preferred that granulating of particle is performed in the course of the grinding so as to achieve a uniform particle diameter. The granulating of particle can be performed by means of a commercially available particle size selector.

Then, the surface of the ground limestone is desirably subjected to treatment with an organic dispersant. This treatment can be conducted by various methods, but preferred is a method in which the treatment is conducted by wet grinding the dry-ground limestone in the presence of an organic dispersant. Specifically, an aqueous medium is added to the limestone so that the limestone/aqueous medium (preferably water) mass ratio becomes in the range of from 30/70 to 85/15, preferably from 60/40 to 80/20, and an organic dispersant is added to the resultant mixture. Examples of organic dispersants include low-molecular or high-molecular water-soluble anionic surfactants having a carboxylate, a sulfate salt, a sulfonate, or a phosphate salt as a functional group, and polyethylene glycol-type or polyhydric alcohol-type nonionic surfactants. Of these, especially preferred is a polyacrylic acid organic dispersant having polyacrylic acid which is a water-soluble anionic surfactant. These organic dispersants are commercially available from, for example, San Nopco Ltd., Toagosei Co., Ltd., and Kao Corporation, and can be used in the present invention. With respect to the amount of the organic dispersant used, there is no particular limitation, but the amount of the organic dispersant used is, relative to 100 parts by mass of the ground limestone, in terms of a solids content, preferably in the range of from 0.3 to 3.5 parts by mass, more preferably in the range of from 0.5 to 3 parts by mass. The obtained pre-dispersed slurry is wet ground by a conventionally known method. Alternatively, an aqueous medium having preliminarily dissolved therein an organic dispersant in an amount in the above-mentioned range is mixed with the limestone and the resultant mixture is wet ground by a conventionally known method. The wet grinding may be conducted in any of a batch-wise manner and a continuous manner, and can be performed by means of an apparatus, for example, a mill using a grinding medium, such as a sand mill, an attritor, a ball mill, or a bead mill. By performing the wet grinding as mentioned above, ground calcium carbonate having an average particle diameter of 0.10 to 0.28 μm can be obtained. Further, for obtaining a predetermined half band width, the obtained ground calcium carbonate is subjected to granulating of particle (granulating reduces the half band width), making it possible to obtain ground calcium carbonate which, in a particle size distribution curve thereof, has at least one peak and has a half band width of 0.25 μm or less with respect to the maximum peak. The method for obtaining the ground calcium carbonate used in the present invention is not limited to the above-described method.

The coating layer in the first embodiment of the invention and the outermost layer in the second embodiment of the invention may contain a conventionally known pigment in addition to the ground calcium carbonate. Examples of conventionally known pigments include various types of kaolin, clay, talc, precipitated calcium carbonate, satin white, lithopone, titanium oxide, zinc oxide, gas phase-process silica, synthetic amorphous silica, colloidal silica, alumina, alumina hydrate, aluminum hydroxide, and a plastic pigment. Two or more types of these pigments may be used in combination.

The coating layer in the first embodiment of the invention and the outermost layer in the second embodiment of the invention individually contain a binder. The binder is a conventionally known water-soluble binder or water-dispersible binder, and examples of the binders include polyacrylic acid polymers, such as sodium polyacrylate and polyacrylamide; a polyvinyl acetate polymer; various copolymer latexes, such as a styrene-butadiene copolymer and an ethylene-vinyl acetate; polyvinyl alcohol; modified polyvinyl alcohol; polyethylene oxide; formalin resins, such as urea and melamine; and water-soluble synthetic materials, such as polyethylene-imine, polyamide polyamine, and epichlorohydrin. Further, examples of the binders include starch obtained by refining natural plants, hydroxyethyl starch, oxidized starch, etherified starch, starch phosphate, enzyme-modified starch, cold water-soluble starch obtained by flash drying the above starch, natural polysaccharides, such as dextrin, mannan, chitosan, arabinogalactan, glycogen, inulin, pectin, hyaluronic acid, carboxymethyl cellulose, and hydroxyethyl cellulose, and oligomers thereof and modification products thereof. Further examples include natural proteins, such as casein, gelatin, soybean protein, and collagen, and modification products thereof, and synthetic polymers and oligomers, such as polylactic acid and peptides. These binders can be used individually or in combination. The binder can be subjected to cation modification before used.

From the viewpoint of the ink absorbing capacity and ink absorption speed with respect to an industrial inkjet printing press, the amount of the binder contained in the coating layer in the first embodiment of the invention or in the outermost layer in the second embodiment of the invention is preferably in the range of from 3 to 30 parts by mass, more preferably in the range of from 5 to 20 parts by mass, relative to 100 parts by mass of the total of pigments in the coating layer or outermost layer.

The coating layer in the first embodiment of the invention and the outermost layer in the second embodiment of the invention individually contain a cationic compound. Examples of such cationic compounds include cationic resins and water-soluble multivalent cation salts. When the coating layer or outermost layer contains a cationic compound, the resultant coated paper can have printability for a conventional printing press for use in, for example, offset printing and further have printability that can cope with the printing speed of an industrial inkjet printing press.

The cationic resin may be a conventionally known cationic polymer or cationic oligomer, and is not particularly limited. A preferred cationic resin is a polymer or oligomer to which a proton is easily coordinated, and which contains a primary, secondary, or tertiary amine or quaternary ammonium salt that is dissociated to be cationic when dissolved in water. Specific examples of the cationic resins include compounds, such as polyethyleneimine, polyvinylpyridine, polyamine sulfone, polydialkylaminoethyl methacrylate, polydialkylaminoethyl acrylate, polydialkylaminoethylmethacrylamide, polydialkylaminoethylacrylamide, polyepoxyamine, polyamideamine, a dicyandiamide-formalin condensation product, a dicyandiamide polyalkyl-polyalkylene polyamine condensation product, polyvinylamine, and polyallylamine, and hydrochlorides thereof; and a diallylamine-acrylamide copolymer, a copolymer of polydiallyldimethylammonium chloride and diallyldimethylammonium chloride and acrylamide or the like, a polydiallylmethylamine hydrochloride, and polycondensation products of an alkylamine and an epihalohydrin compound, such as a dimethylamine-ammonia-epichlorohydrin polycondensation product and a dimethylamine-epichlorohydrin polycondensation product. In the present invention, with respect to the number average molecular weight of the cationic resin, there is no particular limitation, but the number average molecular weight of the cationic resin is preferably 500 to 100,000, more preferably 1,000 to 60,000. From the viewpoint of the ink fixing property with respect to an industrial inkjet printing press, the cationic resin is preferably a dimethylamine-epichlorohydrin polycondensation product, a diallylamine-acrylamide copolymer, and polydiallyldimethylammonium chloride. Further, from the similar point of view, a polycondensation product of an alkylamine and an epihalohydrin compound and a diallylamine-acrylamide copolymer are preferred. Two or more types of the above-described cationic resins may be used in combination.

The water-soluble multivalent cation salt means a water-soluble salt containing a multivalent cation, and the water-soluble salt means a salt which is capable of being dissolved in water at 20° C. in an amount of 1% by mass or more. Examples of multivalent cations include bivalent cations of, for example, magnesium, calcium, strontium, barium, nickel, zinc, copper, iron, cobalt, tin, or manganese; trivalent cations of, for example, aluminum, iron, or chromium; tetravalent cations of, for example, titanium or zirconium; and complex ions thereof. An anion which forms a salt together with a multivalent cation may be either an inorganic acid or an organic acid, and there is no particular limitation. Examples of inorganic acids include hydrochloric acid, nitric acid, phosphoric acid, sulfuric acid, boric acid, and hydrofluoric acid. Examples of organic acids include formic acid, acetic acid, lactic acid, citric acid, oxalic acid, succinic acid, and organic sulfonic acid. From the viewpoint of the ink fixing property with respect to an industrial inkjet printing press, the water-soluble multivalent cation salt is preferably a calcium salt, more preferably calcium chloride, calcium formate, and calcium nitrate. Two or more types of water-soluble multivalent cation salts may be used in combination.

From the viewpoint of achieving the ink fixing property for both an aqueous dye based ink having a dye as a coloring material and an aqueous pigment based ink having a pigment as a coloring material, it is preferred that the coating layer in the first embodiment of the invention and the outermost layer in the second embodiment of the invention individually contain both the cationic resin and water-soluble multivalent cation salt.

In the first embodiment of the invention, from the viewpoint of the ink fixing property and ink absorption speed with respect to an industrial inkjet printing press, and from the viewpoint of the printability for a conventional printing press and the cost for chemical agents, the amount of the cationic compound contained in the coating layer is preferably in the range of from 5 to 30 parts by mass, more preferably in the range of from 10 to 25 parts by mass, relative to 100 parts by mass of the total of pigments in the coating layer.

In the second embodiment of the invention, from the similar point of view, the amount of the cationic compound contained in the outermost layer is preferably in the range of from 10 to 30 parts by mass, more preferably in the range of from 15 to 25 parts by mass, relative to 100 parts by mass of the total of pigments in the outermost layer.

The coating layer in the first embodiment of the invention and the outermost layer in the second embodiment of the invention can contain, in addition to the pigment, binder, and cationic compound, if necessary, conventionally known various additives generally used in the field of paper making, such as a pigment dispersant, a dye, a dye fixing agent, a thermoplastic resin, a surfactant, a defoamer, an antifoamer, a foaming agent, a releasing agent, a penetrating agent, a thermal gelling agent, a lubricant, a thickener, a wetting agent, a printability improver, a tinting color adjustor, an optical brightener, an antioxidant, an ultraviolet light absorber, or an insolubilizer.

The coating layer in the first embodiment of the invention and the outermost layer in the second embodiment of the invention can be obtained by applying a coating layer coating composition onto the support or the under layer and drying the applied composition. As a method for applying the coating layer coating composition onto the support or the under layer, there can be mentioned a method using an application apparatus generally used, but there is no particular limitation. Examples of the application apparatuses include an air-knife coater, various types of blade coaters such as a rod blade coater, a roll coater, a bar coater, a curtain coater, and a short dwell coater. Preferred are various types of blade coaters, a curtain coater, and a film transfer coater, which are suitable for high-speed productivity, and especially preferred are blade coaters. As a drying method, there can be mentioned a method using a drying apparatus generally used, and there is no particular limitation. Examples of the drying apparatuses include various types of drying apparatuses, for example, hot-air dryers, such as a linear tunnel dryer, an arch dryer, an air loop dryer, and a sine curve air-float dryer, an infrared heating dryer, and a dryer using microwaves.

From the viewpoint of achieving both the printability for an offset printing press and the printability for an inkjet printer, the coating weight of the coating layer or outermost layer is preferably in the range of from 5.0 to 20.0 g/m$^2$ per one surface. In the present invention, the coating weight indicates a coating weight per one surface in terms of a dry solids content.

When the coated printing paper for an industrial inkjet printing press of the present invention has two or more coating layers, with respect to the outermost layer of the coating layers, if necessary, the surface can be smoothed by a calendering treatment using, for example, a machine calender, a soft nip calender, a supercalender, a multi-stage calender, or a multi-nip calender. The outermost layer may not be subjected to calendering treatment.

When the coated printing paper for an industrial inkjet printing press has two or more coating layers, the under layer in the coated printing paper for an industrial inkjet printing press contains a pigment and a binder as a main component. The pigment used in the under layer in the coated printing paper for an industrial inkjet printing press is a conventionally known pigment, and examples of the pigments include various types of kaolin, clay, talc, diatomaceous earth, ground calcium carbonate, precipitated calcium carbonate, satin white, lithopone, titanium oxide, zinc oxide, magnesium hydroxide, zeolite, alumina, alumina hydrate, gas phase-process silica, synthetic amorphous silica, colloidal silica, and a plastic pigment. Two or more types of pigments may be used in combination.

The binder used in the under layer in the coated printing paper for an industrial inkjet printing press is a conventionally known binder, and, like the binder used in the coating layer in the first embodiment of the invention or the outermost layer in the second embodiment of the invention, one type or more of binders can be appropriately selected from conventionally known water-dispersible binders and water-soluble binders.

When the binder is incorporated into the under layer in an excess amount relative to the pigment, the image is likely to be stained in industrial inkjet printing, and therefore the amount of the binder contained in the under layer is preferably in the range of from 10 to 40 parts by mass, relative to 100 parts by mass of the total of pigments in the under layer.

The under layer in the coated printing paper for an industrial inkjet printing press can contain, in addition to the pigment and binder, if necessary, conventionally known various additives generally used in the field of paper making, such as a pigment dispersant, a dye fixing agent, a thermoplastic resin, a surfactant, a defoamer, a thickener, a wetting agent, a printability improver, a tinting color adjustor, an optical brightener, an antioxidant, an ultraviolet light absorber, or an insolubilizer.

The above-described under layer can be obtained by applying a under layer coating composition onto the support and drying the applied composition. As a method for applying the under layer coating composition onto the support, there can be mentioned a method using an application apparatus generally used, and there is no particular limitation. Examples of the application apparatuses include various types of coaters, for example, a roll coater, an air-knife coater, a bar coater, various types of blade coaters such as a rod blade coater, a short dwell coater, and a curtain coater. As a drying method, there can be mentioned a method using a drying apparatus generally used, and there is no particular limitation. Examples of the drying apparatuses include various types of drying apparatuses, for example, hot-air dryers, such as a linear tunnel dryer, an arch dryer, an air loop dryer, and a sine curve air-float dryer, an infrared heating dryer, and a dryer using microwaves.

From the viewpoint of the printability for an offset printing press and the ink absorbing capacity with respect to an industrial inkjet printing press, the coating weight of the under layer is preferably in the range of from 4.0 to 20.0 $g/m^2$ per one surface.

With respect to the under layer, if necessary, the surface can be smoothed by a calendering treatment using, for example, a machine calender, a soft nip calender, a supercalender, a multi-stage calender, or a multi-nip calender. The under layer may not be subjected to calendering treatment.

On the other hand, from the viewpoint of the gloss, the outermost layer in the second embodiment of the invention preferably has a 75 degrees glossiness in the range of 45% or more as determined by JIS Z8741.

The gloss of the outermost layer can be controlled by changing the amount or average particle diameter of the ground calcium carbonate contained in the outermost layer, or the type and average particle diameter of the other pigment. Further, the gloss can be controlled by adding a conventionally known matting agent to the outermost layer. The gloss can be improved by a calendering treatment using, for example, a machine calender, a soft nip calender, a supercalender, a multi-stage calender, or a multi-nip calender. When an excessive calendering treatment is conducted, the voids in the outermost layer and under layer are likely to collapse, causing the printability for an industrial inkjet printing press to become poor. Therefore, an appropriate calendering treatment is preferred.

The coated printing paper for an industrial inkjet printing press of the present invention has the above-described coating layer (which is comprised of a single layer or a plurality of layers) on at least one surface of a support. The support is, for example, paper of the following various types:

base paper produced by mixing together wood pulp, for example, chemical pulp, such as LBKP or NBKP, mechanical pulp, such as GP, PGW, RMP, TMP, CTMP, CMP, or CGP, or waste paper pulp, such as DIP, and a conventionally known filler as main components, and a binder and, if necessary, one or more types of various additives, such as a sizing agent, a fixing agent, a retention aid, a cationization agent, or a paper strengthening additive, and subjecting the resultant mixture to paper making using an apparatus, such as a fourdrinier paper machine, a cylinder paper machine, or a twin wire paper machine;

woodfree paper obtained by sizing the base paper with, for example, starch or polyvinyl alcohol by a size press or by forming an anchor coat layer on the base paper; and coated paper obtained by further forming a coat layer on the woodfree paper, such as art paper, coated paper, cast coated paper, and baryta paper.

With respect to the base paper, woodfree paper, or coated paper, if necessary, the surface can be smoothed by means of, for example, a machine calender, a soft nip calender, a supercalender, a multi-stage calender, or a multi-nip calender. The support may be a base paper coated with a resin.

From the viewpoint of the environmental problems about waste liquor containing boron discharged from the production process, it is preferred that the support in the coated printing paper for an industrial inkjet printing press of the present invention contains neither a boric acid compound nor a borate compound.

In the present invention, it is preferred that the coated printing paper for an industrial inkjet printing press has the above-described coating layer on both surfaces thereof. By forming the coating layer on both surfaces of the coated printing paper, the coated printing paper can obtain image quality as excellent as A2 coated paper on the both surfaces thereof.

EXAMPLES

Hereinbelow, the present invention will be described in more detail with reference to the following Examples, which should not be construed as limiting the scope of the present invention. In the following Examples, the "part(s) by mass", "% by mass", and "% by volume" individually indicate a value of dry solids content or substantial component unless otherwise specified.

<Measurement of an Average Particle Diameter and a Half Band Width of the Maximum Peak>

With respect to the surface of the coated printing paper obtained in <Preparation of coated printing paper> below, a photograph was taken by means of a scanning electron microscope (JSM-6490LA, manufactured by JEOL Ltd.). A particle seen in the taken image was regarded as a circle which has an area approximating to that of the particle and a particle diameter of the circle was calculated, and particle diameters of 100 particles present in the image were measured to determine an average particle diameter by calculation. A particle size distribution curve in which the ordinate gives a relative frequency (%) and the abscissa gives a particle diameter (μm) was obtained using a particle image analysis software from the particle diameter data measured with respect to the 100 particles. From the obtained particle size distribution curve, a width at a height which is ½ of the peak height of the maximum peak was determined as a half band width. The determined average particle diameter and half band width of the maximum peak are shown in Table 1 below.

<Preparation of Ground Calcium Carbonate>

The ground calcium carbonate used in the Examples and Comparative Examples below was prepared as follows. Natural limestone was roughly ground by means of a jaw crusher, a hammer crusher, and a roller mill until the average particle diameter of the resultant ground limestone became about 30 μm, and, if necessary, the ground limestone was subjected to granulating of particle so that a half band width of the maximum peak in a particle size distribution curve thereof finally became the half band width of the ground calcium carbonate shown in Tables 1 and 2 below, and water and a commercially available polyacrylic acid dispersant were added to the resultant limestone to form a pre-dispersed slurry having a solids content of about 75% by mass. The pre-dispersed slurry was treated using a wet-grinder, manufactured by Ashizawa Finetech Ltd. (horizontal bead mill; size of the cylindrical grinding chamber: diameter: about 0.5 m; length: about 1.3 m), and then, if necessary, the resultant slurry was subjected to granulating of particle so that a half band width of the maximum peak in a particle size distribution curve thereof became the half band width of the ground calcium carbonate shown in Tables 1 and 2 below. As beads, those being made of zirconia and having a diameter of about 0.2 mm were used. The packing ratio of the beads was changed in the range of from 80 to 85% by volume. The flow rate was about 15 liters/minute, and the pass number was changed. Ground calcium carbonates having various average particle diameter and half band width values shown in Tables 1 and 2 below were prepared according to the above-mentioned procedure.

The above-prepared ground calcium carbonate was used in producing the coated printing paper in each of the Examples and Comparative Examples. A particle size distribution diagram of the ground calcium carbonate used in Example 1 is shown in FIG. 1.

In the Case of a Single Coating Layer

Examples 1 to 13 and Comparative Examples 1 to 12

Preparation of a Support

To 100 parts by mass of a pulp slurry comprised of LBKP having a freeness of 400 mlcsf were added 10 parts by mass of precipitated calcium carbonate as a filler, 0.8 part by mass of amphoteric starch, 0.8 part by mass of aluminum sulfate, and 0.1 part by mass of an alkylketene dimer-type sizing agent (Sizepine K903, manufactured by Arakawa Chemical Industries, Ltd.). The resultant mixture was subjected to paper making using a fourdrinier paper machine, and oxidized starch was applied using a size press on both surfaces of the resultant paper at 2.5 g/m$^2$, and the paper was subjected to machine calendering treatment to prepare base paper having a basis weight of 100 g/m$^2$, and the prepared base paper was used as a support.

<Preparation of a Coating Layer Coating Composition>

A coating layer coating composition having the formulation shown below was prepared.

| | |
|---|---|
| Ground calcium carbonate and other pigments | The respective amounts are shown in Table 1. |
| Cationic compounds | The respective amounts are shown in Table 1. |
| Styrene-butadiene copolymer latex (JSR-2605G, manufactured by JSR Corporation) | 10 Parts by mass |
| Starch phosphate (MS#4600, manufactured by Nihon Shokuhin Kako Co., Ltd.) | 10 Parts by mass |
| Acetylene glycol derivative (Olfine-E1010, manufactured by Nissin Chemical Co., Ltd.) | 0.3 Part by mass |

The ingredients having the formulation shown above were incorporated, and mixed with and dispersed in water to obtain a coating layer coating composition having a solids content controlled to be 40% by mass.

TABLE 1

| | Coating Layer | | | | | | | | | | Evaluation of printed material | |
|---|---|---|---|---|---|---|---|---|---|---|---|---|
| | | | | Half band | Cationic compound | | | | | | Industrial inkjet printing press | |
| | | Pigment | Average | width of | a | b | c | d | e | | | |
| | Type | Amount Parts by mass | particle diameter μm | maximum peak μm | Parts by mass | Parts by mass | Parts by mass | Parts by mass | Parts by mass | Offset printing press | Printing speed 75 m/min. | Printing speed 150 m/min. |
| Example 1 | Ground calcium carbonate | 100 | 0.20 | 0.19 | 20 | — | — | — | — | AA | AA | A |
| Example 2 | Ground calcium carbonate | 100 | 0.12 | 0.13 | 20 | — | — | — | — | AA | AA | A |
| Example 3 | Ground calcium carbonate | 100 | 0.23 | 0.23 | 20 | — | — | — | — | AA | AA | A |
| Example 4 | Ground calcium carbonate | 100 | 0.28 | 0.25 | 20 | — | — | — | — | AA | AA | A |
| Example 5 | Ground calcium carbonate | 60 | 0.20 | 0.19 | 20 | — | — | — | — | A | A | A |
| | Kaolin A | 40 | 0.19 | — | | | | | | | | |

TABLE 1-continued

| | Coating Layer | | | | Cationic compound | | | | | | Evaluation of printed material | |
|---|---|---|---|---|---|---|---|---|---|---|---|---|
| | Pigment | | Average | Half band width of | a | b | c | d | e | | Industrial inkjet printing press | |
| | Type | Amount Parts by mass | particle diameter μm | maximum peak μm | Parts by mass | Parts by mass | Parts by mass | Parts by mass | Parts by mass | Offset printing press | Printing speed 75 m/min. | Printing speed 150 m/min. |
| Example 6 | Ground calcium carbonate | 80 | 0.20 | 0.19 | 20 | — | — | — | — | AA | A | A |
| | Kaolin A | 20 | 0.19 | — | | | | | | | | |
| Example 7 | Ground calcium carbonate | 60 | 0.20 | 0.19 | 20 | — | — | — | — | A | A | A |
| | Precipated calcium cabonate A | 40 | 0.63 | — | | | | | | | | |
| Example 8 | Ground calcium carbonate | 100 | 0.20 | 0.19 | — | 20 | — | — | — | AA | AA | A |
| Example 9 | Ground calcium carbonate | 100 | 0.20 | 0.19 | — | — | 20 | — | — | A | A | A |
| Example 10 | Ground calcium carbonate | 100 | 0.20 | 0.19 | 10 | — | — | 10 | — | AA | AA | AA |
| Example 11 | Ground calcium carbonate | 100 | 0.20 | 0.19 | 10 | — | — | — | 10 | AA | AA | A |
| Example 12 | Ground calcium carbonate | 100 | 0.20 | 0.19 | — | 10 | — | 10 | — | AA | AA | AA |
| Example 13 | Ground calcium carbonate | 100 | 0.20 | 0.19 | — | 10 | — | — | 10 | AA | A | A |
| Comparative Example 1 | Ground calcium carbonate | 100 | 0.20 | 0.37 | 20 | — | — | — | — | AA | AA | B |
| Comparative Example 2 | Ground calcium carbonate | 100 | 0.12 | 0.31 | 20 | — | — | — | — | AA | AA | B |
| Comparative Example 3 | Ground calcium carbonate | 100 | 0.23 | 0.41 | 20 | — | — | — | — | AA | AA | B |
| Comparative Example 4 | Ground calcium carbonate | 100 | 0.28 | 0.43 | 20 | — | — | — | — | AA | AA | B |
| Comparative Example 5 | Ground calcium carbonate | 100 | 0.07 | 0.08 | 20 | — | — | — | — | A | B | C |
| Comparative Example 6 | Ground calcium carbonate | 100 | 0.35 | 0.38 | 20 | — | — | — | — | A | B | C |
| Comparative Example 7 | Ground calcium carbonate | 100 | 0.73 | 1.1 | 20 | — | — | — | — | B | B | C |
| Comparative Example 8 | Ground calcium carbonate | 50 | 0.20 | 0.37 | 20 | — | — | — | — | B | B | C |
| | Kaolin A | 50 | 0.19 | | | | | | | | | |
| Comparative Example 9 | Kaolin B | 100 | 1.10 | — | 20 | — | — | — | — | B | C | C |
| Comparative Example 10 | Precipitated calcium carbonate B | 100 | 0.15 | — | 20 | — | — | — | — | B | C | C |
| Comparative Example 11 | Colloidal silica | 100 | 0.20 | — | 20 | — | — | — | — | C | C | C |
| Comparative Example 12 | Ground calcium carbonate | 100 | 0.20 | 0.19 | — | — | — | — | — | A | B | C |

The commercially available pigments shown in Table 1 are as follows.

Precipitated calcium carbonate A (TP123, manufactured by Okutama Kogyo Co., Ltd.; average particle diameter: 0.63 μm)

Precipitated calcium carbonate B (Brilliant-15, manufactured by Shiraishi Calcium Kaisha, Ltd.; average particle diameter: 0.15 μm)

Kaolin A (HG90, manufactured by J. M. Huber Corporation; average particle diameter: 0.19 μm)

Kaolin B (KAOFINE 90, manufactured by Shiraishi Calcium Kaisha, Ltd.; average particle diameter: 1.10 μm)

Colloidal silica (Colloidal Silica MP-2040, manufactured by Nissan Chemical Industries, Ltd.; average particle diameter: 0.20 μm)

Ground calcium carbonate used in Comparative Example 7 (FMT-OP2A, manufactured by Fimatec Ltd.; average particle diameter: 0.73 μM; half band width: 1.10 μm)

A particle size distribution diagram of the commercially available ground calcium carbonate used in Comparative Example 7 is shown in FIG. 2.

The cationic compounds indicated by abbreviations in Table 1 are as follows.

a: Dimethylamine-epichlorohydrin polycondensation product (JETFIX 5052, manufactured by Satoda Chemical Industrial Co., Ltd.)

b: Diallylamine-acrylamide copolymer (SR1001, manufactured by Sumitomo Chemical Co., Ltd.)

c: Polyethyleneimine (EPOMIN, manufactured by Nippon Shokubai Co., Ltd.)

d: Calcium chloride e: Magnesium sulfate

<Preparation of Coated Printing Paper>

Coated printing paper in each of the Examples and Comparative Examples was prepared in accordance with the following procedure. Specifically, the coating layer coating composition was applied to both surfaces of a support by means of a blade coater and dried, and then subjected to calendering treatment to prepare a coated paper. The coating weight was 10 g/m$^2$ per one surface in terms of a solids content.

<Printing by an Offset Printing Press>

Using an offset form rotary press, manufactured by Miyakoshi Printing Machinery, Co., Ltd., as an offset printing press, a predetermined image for evaluation was repeatedly printed 6,000 m under the following conditions: printing speed: 150 m/min; ink used: T&K TOKA UV Best Cure Black and Bronze Red; and UV irradiation dose: 8 kW×2, thus producing a printed material.

<Printing by an Industrial Inkjet Printing Press>

Using a printer Prosper 5000XL Press, manufactured by Eastman Kodak Company, as an industrial inkjet printing press, a predetermined image for evaluation was printed 6,000 m under the following conditions: printing speed: in two stages at 75 m/min and 150 m/min; and ink used: aqueous pigment based ink, thus producing a printed material.

<Evaluation of a Printed Material>

With respect to the obtained printed material, visual evaluation of the image quality was made. In the offset printing, the degree of lowering of the image quality due to printing failure caused by blanket piling was visually observed, and, in the industrial inkjet printing, the degree of lowering of the image quality due to a lack of the ink absorption speed or poor dot diffusion of the ink and, as a rub resistance, the state of the ink peeled off when rubbing the printed material with a hand were individually visually observed, and they were collectively evaluated in accordance with the four criteria shown below for visual evaluation. The coated printing paper for an industrial inkjet printing press having any of ratings AA and A for evaluation in the criteria below has the effects of the present invention.

AA: The printed material suffers no lowering of the image quality, and has satisfactory image quality as a commercial product irrespective of the use of the printed material.

A: The printed material suffers a slight lowering of the image quality, and has satisfactory image quality as a commercial product irrespective of the use of the printed material.

B: The printed material suffers a lowering of the image quality, and does not have satisfactory image quality as a commercial product depending on the use of the printed material.

C: The printed material suffers a lowering of the image quality, and does not have satisfactory image quality as a commercial product irrespective of the use of the printed material.

The results of the evaluation with respect to each of the Examples and Comparative Examples are shown in Table 1 above.

As apparent from Table 1, Examples 1 to 13, which correspond to the coated printing paper for an industrial inkjet printing press of the present invention, have printability for a conventional printing press for use in, for example, offset printing and further have printability for an industrial inkjet printing press, and can produce a printed material having satisfactory image quality as a commercial product. On the other hand, Comparative Examples 1 to 12, which do not correspond to the coated printing paper for an industrial inkjet printing press of the present invention, do not have the at least one printability, and cannot produce a printed material having satisfactory image quality as a commercial product.

In the Case of Two Coating Layers

Examples 14 to 35 and Comparative Examples 13 to 24

Preparation of a Support

To 100 parts by mass of a pulp slurry comprised of LBKP having a freeness of 400 mlcsf were added 10 parts by mass of precipitated calcium carbonate as a filler, 0.8 part by mass of amphoteric starch, 0.8 part by mass of aluminum sulfate, and 0.15 part by mass of an alkylketene dimer-type sizing agent (Sizepine K903, manufactured by Arakawa Chemical Industries, Ltd.). The resultant mixture was subjected to paper making using a fourdrinier paper machine, and oxidized starch was applied using a size press on both surfaces of the resultant paper at 2.5 g/m$^2$, and the paper was subjected to machine calendering treatment to prepare base paper having a basis weight of 100 g/m$^2$, and the prepared base paper was used as a support.

<Preparation of a Under Layer Coating Composition>

A under layer coating composition having the formulation shown below was prepared.

Pigments The respective types and amounts are shown in Table 2. Polyvinyl alcohol (degree of saponification: 98 mol %; average degree of polymerization: 1,700) 25 Parts by mass The ingredients having the formulation shown above were incorporated, and mixed with and dispersed in water to obtain a under layer coating composition having a solids content controlled to be 25% by mass.

<Preparation of an Outermost Layer Coating Composition>

An outermost layer coating composition having the formulation shown below was prepared.

Pigments The respective types and amounts are shown in Table 2.

Cationic compounds The respective types and amounts are shown in Table 2.

Styrene-butadiene copolymer latex (SNX-4205R, manufactured by Nippon A&L Inc.)

Starch phosphate (MS#4600, manufactured by Nihon Shokuhin Kako Co., Ltd.)

10 Parts by mass

The ingredients having the formulation shown above were incorporated, and mixed with and dispersed in water to obtain an outermost layer coating composition having a solids content controlled to be 40% by mass.

TABLE 2

| | Under layer coating composition Pigment | | Outermost layer coating composition Pigment | | | | Cationic compound | | Evaluation of printed material by offset printing press | Evaluation of printed material by industrial inkjet printing press: Printing speed for aqueous pigment based ink | | Printing speed for aqueous dye based ink |
|---|---|---|---|---|---|---|---|---|---|---|---|---|
| | Type | Amount Parts by mass | Type | Average particle diameter μm | Half band width of maximum peak μm | Amount Parts by mass | Type | Amount Parts by mass | | 75 m/min. | 150 m/min. | 128 m/min. |
| Example14 | Synthetic amorphous silica | 100 | Ground calcium carbonate | 0.20 | 0.19 | 100 | Dimethylamine-epichlorohydrin polycondensation product | 20 | AA | A | A | AA |
| Example15 | Synthetic amorphous silica<br>Precipitated calcium carbonate | 70<br>30 | Ground calcium carbonate | 0.20 | 0.19 | 100 | Dimethylamine-epichlorohydrin polycondensation product | 20 | AA | A | A | A |
| Example16 | Synthetic amorphous silica<br>Precipitated calcium carbonate | 90<br>10 | Ground calcium carbonate | 0.20 | 0.19 | 100 | Dimethylamine-epichlorohydrin polycondensation product | 20 | AA | A | A | AA |
| Example17 | Synthetic amorphous silica<br>Ground calcium carbonate | 70<br>30 | Ground calcium carbonate | 0.20 | 0.19 | 100 | Dimethylamine-epichlorohydrin polycondensation product | 20 | AA | A | A | A |
| Example18 | Synthetic amorphous silica<br>Kaolin | 100 | Ground calcium carbonate | 0.20 | 0.19 | 100 | Dimethylamine-epichlorohydrin polycondensation product | 20 | A | A | A | A |
| Example19 | Precipitated calcium carbonate | 100 | Ground calcium carbonate | 0.20 | 0.19 | 100 | Dimethylamine-epichlorohydrin polycondensation product | 20 | AA | A | A | A |
| Example20 | Ground calcium carbonate | 100 | Ground calcium carbonate | 0.20 | 0.19 | 100 | Dimethylamine-epichlorohydrin polycondensation product | 20 | AA | A | A | A |
| Example21 | Synthetic amorphous silica | 100 | Ground calcium carbonate | 0.12 | 0.13 | 100 | Dimethylamine-epichlorohydrin polycondensation product | 20 | AA | A | A | AA |
| Example22 | Synthetic amorphous silica | 100 | Ground calcium carbonate | 0.23 | 0.23 | 100 | Dimethylamine-epichlorohydrin polycondensation product | 20 | AA | A | A | AA |
| Example23 | Synthetic amorphous silica | 100 | Ground calcium carbonate | 0.28 | 0.25 | 100 | Dimethylamine-epichlorohydrin polycondensation product | 20 | AA | A | A | A |
| Example24 | Synthetic amorphous silica | 100 | Ground calcium carbonate<br>Kaolin A | 0.20<br>0.19 | 0.19<br>— | 60<br>40 | Dimethylamine-epichlorohydrin polycondensation product | 20 | A | A | A | A |
| Example25 | Synthetic amorphous silica | 100 | Ground calcium carbonate<br>Kaolin A | 0.20<br>0.19 | 0.19<br>— | 80<br>20 | Dimethylamine-epichlorohydrin polycondensation product | 20 | AA | A | A | AA |
| Example26 | Synthetic amorphous silica | 100 | Ground calcium carbonate<br>Precipitated calcium carbonate A | 0.20<br>0.63 | 0.19<br>— | 60<br>40 | Dimethylamine-epichlorohydrin polycondensation product | 20 | AA | A | A | A |
| Example27 | Synthetic amorphous silica | 100 | Ground calcium carbonate<br>Precipitated calcium carbonate A | 0.20<br>0.63 | 0.19<br>— | 80<br>20 | Dimethylamine-epichlorohydrin polycondensation product | 20 | AA | A | A | A |
| Example28 | Synthetic amorphous silica | 100 | Ground calcium carbonate | 0.20 | 0.19 | 100 | Dimethylamine-epichlorohydrin polycondensation product | 10 | AA | A | A | A |
| Example29 | Synthetic amorphous silica | 100 | Ground calcium carbonate | 0.20 | 0.19 | 100 | Dimethylamine-epichlorohydrin polycondensation product | 30 | A | A | A | AA |
| Example30 | Synthetic amorphous silica | 100 | Ground calcium carbonate | 0.20 | 0.19 | 100 | Diallylamine-acrylamide copolymer | 20 | AA | A | A | AA |
| Example31 | Synthetic amorphous silica | 100 | Ground calcium carbonate | 0.20 | 0.19 | 100 | Polyethyleneimine | 20 | A | A | A | A |
| Example32 | Synthetic amorphous silica | 100 | Ground calcium carbonate | 0.20 | 0.19 | 100 | Calcium chloride | 20 | A | AA | AA | A |
| Example33 | Synthetic amorphous silica | 100 | Ground calcium carbonate | 0.20 | 0.19 | 100 | Magnesium sulfate | 20 | A | A | A | A |

TABLE 2-continued

| | Under layer coating composition Pigment | | Outermost layer coating composition Pigment | | | | Cationic compound | | Evaluation of printed material by offset printing press | Evaluation of printed material by industrial inkjet printing press: Printing speed for aqueous pigment based ink | | Printing speed for aqueous dye based ink |
|---|---|---|---|---|---|---|---|---|---|---|---|---|
| | Type | Amount Parts by mass | Type | Average particle diameter μm | Half band width of maximum peak μm | Amount Parts by mass | Type | Amount Parts by mass | | 75 m/min. | 150 m/min. | 128 m/min. |
| Example34 | Synthetic amorphous silica | 100 | Ground calcium carbonate | 0.20 | 0.19 | 100 | Dimethylamine-epichlorohydrin polycondensation product<br>Calcium chloride | 10<br>10 | A | AA | AA | AA |
| Example35 | Synthetic amorphous silica | 100 | Ground calcium carbonate | 0.20 | 0.19 | 100 | Diallylamine-acrylamide copolymer<br>Calcium chloride | 10<br>10 | A | AA | AA | AA |
| Comparative Example 13 | Synthetic amorphous silica | 100 | Ground calcium carbonate | 0.07 | 0.08 | 100 | Dimethylamine-epichlorohydrin polycondensation product | 20 | A | B | C | A |
| Comparative Example 14 | Synthetic amorphous silica | 100 | Ground calcium carbonate | 0.35 | 0.38 | 100 | Dimethylamine-epichlorohydrin polycondensation product | 20 | A | B | C | B |
| Comparative Example 15 | Synthetic amorphous silica | 100 | Ground calcium carbonate<br>Kaolin A | 0.20<br>0.19 | 0.37<br>— | 50<br>50 | Dimethylamine-epichlorohydrin polycondensation product | 20 | B | B | C | C |
| Comparative Example 16 | Synthetic amorphous silica | 100 | Kaolin B | 1.10 | — | 100 | Dimethylamine-epichlorohydrin polycondensation product | 20 | B | C | C | C |
| Comparative Example 17 | Synthetic amorphous silica | 100 | Precipitated calcium carbonate B | 0.15 | — | 100 | Dimethylamine-epichlorohydrin polycondensation product | 20 | B | C | C | B |
| Comparative Example 18 | Synthetic amorphous silica | 100 | Colloidal silica | 0.20 | — | 100 | Dimethylamine-epichlorohydrin polycondensation product | 20 | C | B | C | B |
| Comparative Example 19 | Synthetic amorphous silica | 100 | Ground calcium carbonate | 0.20 | 0.19 | 100 | — | — | A | B | C | C |
| Comparative Example 20 | Synthetic amorphous silica | 100 | Ground calcium carbonate | 0.20 | 0.37 | 100 | Dimethylamine-epichlorohydrin polycondensation product | 20 | AA | A | B | A |
| Comparative Example 21 | Synthetic amorphous silica | 100 | Ground calcium carbonate | 0.12 | 0.31 | 100 | Dimethylamine-epichlorohydrin polycondensation product | 20 | AA | A | B | A |
| Comparative Example 22 | Synthetic amorphous silica | 100 | Precipitated calcium carbonate C | 0.23 | — | 100 | Dimethylamine-epichlorohydrin polycondensation product | 20 | AA | A | B | A |
| Comparative Example 23 | Synthetic amorphous silica | 100 | Ground calcium carbonate | 0.28 | 0.43 | 100 | Dimethylamine-epichlorohydrin polycondensation product | 20 | AA | A | B | B |
| Comparative Example 24 | Synthetic amorphous silica | 100 | Ground calcium carbonate | 0.73 | 1.10 | 100 | Dimethylamine-epichlorohydrin polycondensation product | 20 | A | B | C | C |

The pigments shown in Table 2 are as follows.

(Under Layer)

Synthetic amorphous silica (NIPGEL AZ-204, manufactured by Tosoh Silica Corporation)

Precipitated calcium carbonate (Cal-Light KT, manufactured by Shiraishi Kogyo Kaisha, Ltd.)

Ground calcium carbonate (SETACARB-HG, manufactured by Shiraishi Calcium Kaisha, Ltd.)

Kaolin (KAOFINE 90, manufactured by Shiraishi Calcium Kaisha, Ltd.)

(Outermost Layer)

Precipitated calcium carbonate A (TP123, manufactured by Okutama Kogyo Co., Ltd.; average particle diameter: 0.63 μm)

Precipitated calcium carbonate B (Brilliant-15, manufactured by Shiraishi Calcium Kaisha, Ltd.; average particle diameter: 0.15 μm)

Precipitated calcium carbonate C (TP221HDP, manufactured by Okutama Kogyo Co., Ltd.; average particle diameter: 0.23 μm)

Kaolin A (HG90, manufactured by J. M. Huber Corporation; average particle diameter: 0.19 μm)

Kaolin B (KAOFINE 90, manufactured by Shiraishi Calcium Kaisha, Ltd.; average particle diameter: 1.10 μm)

Colloidal silica (Colloidal Silica MP-2040, manufactured by Nissan Chemical Industries, Ltd.; average particle diameter: 0.20 μm)

Ground calcium carbonate used in Comparative Example 24 (FMT-OP2A, manufactured by Fimatec Ltd.; average particle diameter: 0.73 μm; half band width: 1.10 μm)

<Preparation of Coated Printing Paper>

Coated paper in each of the Examples and Comparative Examples was prepared in accordance with the following procedure. Specifically, the under layer coating composition was applied to both surfaces of a support at 10 g/m$^2$ per one surface using an air-knife coater and dried. After drying, the outermost layer coating composition was applied to both surfaces of the resultant support at 10 g/m$^2$ per one surface using a blade coater and dried. After drying, the resultant support was subjected to calendering treatment to prepare a coated printing paper. The calendering was performed using an apparatus comprising an elastic roll and a metal roll at a linear pressure of 120 kN/m with a nip linear pressure in such a range that an appropriate thickness profile in the width direction was able to be obtained. The temperature of the metal roll was 50° C.

<Printing by an Offset Printing Press>

Using an offset form rotary press, manufactured by Miyakoshi Printing Machinery, Co., Ltd., as an offset printing press, a predetermined image for evaluation was repeatedly printed 6,000 m under the following conditions: printing speed: 150 m/min; ink used: T&K TOKA UV Best Cure Black and Bronze Red; and UV irradiation dose: 8 kW×2, thus producing a printed material.

<Printing by an Industrial Inkjet Printing Press>

Using a printer Prosper 5000XL Press, manufactured by Eastman Kodak Company, as an industrial inkjet printing press, a predetermined image for evaluation was printed 6,000 m under the following conditions: printing speed: in two stages at 75 m/min and 150 m/min; and ink used: aqueous pigment based ink, thus producing a printed material.

Further, using a printer Truepress Jet520, manufactured by Dainippon Screen Mfg. Co., Ltd., as an industrial inkjet printing press, a predetermined image for evaluation was printed 6,000 m under the following conditions: printing speed: 128 m/min; and ink used: aqueous dye based ink, thus producing a printed material.

<Evaluation of a Printed Material>

With respect to the obtained printed material, visual evaluation of the image quality was made. In the offset printing, the degree of lowering of the image quality due to printing failure caused by blanket piling was visually observed, and, in the industrial inkjet printing, the degree of lowering of the image quality due to a lack of the ink absorption speed or poor dot diffusion of the ink and, as a rub resistance, the state of the ink peeled off when rubbing the printed material with a hand were individually visually observed, and they were collectively evaluated in accordance with the four criteria shown below for visual evaluation. The coated printing paper for an industrial inkjet printing press having any of ratings AA and A for evaluation in the criteria below has the effects of the present invention.

AA: The printed material suffers no lowering of the image quality, and has satisfactory image quality as a commercial product irrespective of the use of the printed material.

A: The printed material suffers a slight lowering of the image quality, and has satisfactory image quality as a commercial product irrespective of the use of the printed material.

B: The printed material suffers a lowering of the image quality, and does not have satisfactory image quality as a commercial product depending on the use of the printed material.

C: The printed material suffers a lowering of the image quality, and does not have satisfactory image quality as a commercial product irrespective of the use of the printed material.

The results of the evaluation with respect to each of the Examples and Comparative Examples are shown in Table 2 above.

As apparent from Table 2, Examples 14 to 35, which correspond to the coated printing paper for an industrial inkjet printing press of the present invention, have both printability for a conventional printing press for use in, for example, offset printing and printability for an industrial inkjet printing press, and can produce a printed material having satisfactory image quality such that the printed material can be a commercial product, and a rub resistance. On the other hand, Comparative Examples 13 to 24, which do not correspond to the coated printing paper for an industrial inkjet printing press of the present invention, do not have the at least one printability, and cannot produce a printed material having satisfactory image quality such that the printed material can be a commercial product.

The invention claimed is:

1. A coated printing paper for an industrial inkjet printing press, having:

a support; and on at least one surface of the support, a coating layer containing at least a binder, a cationic compound, and ground calcium carbonate which, in a particle size distribution curve thereof, has at least one peak and has a half band width of 0.25 μm or less with respect to the maximum peak, and which has an average particle diameter of 0.10 to 0.28 μm.

2. The coated printing paper for an industrial inkjet printing press according to claim 1, wherein the coating layer comprises a single layer.

3. The coated printing paper for an industrial inkjet printing press according to claim 1, wherein the amount of the ground calcium carbonate contained in the coating layer is 60 parts by mass or more, relative to 100 parts by mass of the total of a pigment in the coating layer.

4. A coated printing paper for an industrial inkjet printing press, having: a support; and, on at least one surface of the support, two or more coating layers each comprised mainly of a pigment and a binder, wherein the at least one pigment in the outermost layer formed furthest from the support as a basis is ground calcium carbonate which, in a particle size distribution curve thereof, has at least one peak and has a half band width of 0.25 μm or less with respect to the maximum peak, and which has an average particle diameter of 0.10 to 0.28 μm, wherein the amount of the ground calcium carbonate contained in the outermost layer is 60 parts by mass or more, relative to 100 parts by mass of the total of the pigment in the outermost layer, the outermost layer containing a cationic compound.

5. The coated printing paper for an industrial inkjet printing press according to claim 1, wherein the coating layer contains a cationic resin and a water-soluble multivalent cation salt as the cationic compound, wherein the cationic resin is a polycondensation product of an alkylamine and an epihalohydrin compound or a diallylamine-acrylamide copolymer, and wherein the water-soluble multivalent cation salt is a calcium salt.

6. The coated printing paper for an industrial inkjet printing press according to claim 4, wherein the outermost layer contains a cationic resin and a water-soluble multivalent cation salt as the cationic compound, wherein the cationic resin is a polycondensation product of an alkylamine and an epihalohydrin compound or a diallylamine-acrylamide copolymer, and wherein the water-soluble multivalent cation salt is a calcium salt.

7. The coated printing paper for an industrial inkjet printing press according to claim 2, wherein the amount of the ground calcium carbonate contained in the coating layer is 60 parts by mass or more, relative to 100 parts by mass of the total of a pigment in the coating layer.

8. The coated printing paper for an industrial inkjet printing press according to claim 2, wherein the coating layer contains a cationic resin and a water-soluble multivalent cation salt as the cationic compound, wherein the cationic resin is a polycondensation product of an alkylamine and an epihalohydrin compound or a diallylamine-acrylamide copolymer, and wherein the water-soluble multivalent cation salt is a calcium salt.

9. The coated printing paper for an industrial inkjet printing press according to claim 3, wherein the coating layer contains a cationic resin and a water-soluble multivalent cation salt as the cationic compound, wherein the cationic resin is a polycondensation product of an alkylamine and an epihalohydrin compound or a diallylamine-acrylamide copolymer, and wherein the water-soluble multivalent cation salt is a calcium salt.

10. The coated printing paper for an industrial inkjet printing press according to claim 7, wherein the coating layer contains a cationic resin and a water-soluble multivalent cation salt as the cationic compound, wherein the cationic resin is a polycondensation product of an alkylamine and an epihalohydrin compound or a diallylamine-acrylamide copolymer, and wherein the water-soluble multivalent cation salt is a calcium salt.

* * * * *